US005103209A

United States Patent [19]

Lizzi et al.

[11] Patent Number: 5,103,209

[45] Date of Patent: Apr. 7, 1992

[54] ELECTRONIC ARTICLE SURVEILLANCE SYSTEM WITH IMPROVED DIFFERENTIATION

[75] Inventors: Phillip Lizzi, Deptford, N.J.; Richard Shandelman, Levittown, Pa.

[73] Assignee: Checkpoint Systems, Inc., Thorofare, N.J.

[21] Appl. No.: 674,426

[22] Filed: Mar. 22, 1991

Related U.S. Application Data

[63] Continuation of Ser. No. 295,064, Jan. 9, 1989, abandoned.

[51] Int. Cl.[5] ..... G08B 13/14

[52] U.S. Cl. ..... 340/572; 340/511; 340/825.63

[58] Field of Search ..... 340/572, 551, 825.63, 340/511; 377/1, 27, 50

[56] References Cited

U.S. PATENT DOCUMENTS

| | | | |
|---|---|---|---|
| 4,013,965 | 3/1977 | Scharfe, Jr. | 178/89 |
| 4,356,477 | 10/1982 | Vandebult | 340/572 |
| 4,663,612 | 5/1987 | Mejia et al. | 340/551 |
| 4,686,517 | 8/1987 | Fockens | 340/572 |
| 4,779,077 | 10/1988 | Lichtblau | 340/572 |
| 4,812,822 | 3/1989 | Feltz et al. | 340/572 |
| 5,001,458 | 3/1991 | Tyrén et al. | 340/572 |

*Primary Examiner*—Jin F. Ng
*Assistant Examiner*—Thomas I. Mullen, Jr.
*Attorney, Agent, or Firm*—Weiser & Stapler

[57] ABSTRACT

An electronic article surveillance system which is capable of reliably identifying and discriminating between the different signatures of tags and labels which may come to pass in its vicinity, improving the reliability of the system and even permitting the tags and labels to be classified by type, and separately addressed, includes a receiver for detecting signals resulting from such tags or labels which incorporates improvements in its filtering and processing sections. A linear phase (constant group delay) filter is used to more effectively preserve the signal which is received, and thereby improve the signal which is ultimately delivered to the processor which follows. The processor is provided with a "hysteresis-type" threshold detector which operates to further preserve the original signal by improving the shape (width) of the pulse which is ultimately delivered to the processor following conversion from analog form, and an adaptive processing routine which varies the subsequent processing of detected signals according to changes within the system to improve the system's ability to discriminate between the different signals which are received.

19 Claims, 7 Drawing Sheets

ELECTRONIC ARTICLE SURVEILLANCE SYSTEM WITH IMPROVED DIFFERENTIATION

This application is a continuation of application Ser. No. 07/295,064, filed Jan. 9, 1989, now abandoned.

BACKGROUND OF THE INVENTION

The present invention generally relates to electronic security systems, and in particular, to an improved electronic article surveillance system.

A variety of electronic article surveillance systems have been proposed and implemented to restrict the unauthorized removal of articles from a particular premises. One common form of this is the electronic article surveillance system which has come to be placed near the exits of retail establishments, libraries and the like. However, electronic article surveillance systems are also used for purposes of process and inventory controls, to track articles as they pass through a particular system, among other applications.

Irrespective of the application involved, such electronic article surveillance systems generally operate upon a common principle. Articles to be monitored are provided with tags (of various different types) which contain a circuit (a resonant circuit) for reacting with an applied radio-frequency field. A transmitter and a transmitting antenna are provided to develop this applied field, and a receiver and a receiving antenna are provided to detect disturbances in the applied field. If the resonant circuit of a tag is passed between the transmitting and receiving antennas (which are generally placed near the point of exit from a given premises), the applied field is affected in such fashion that a detectable event is produced within the receiver. This is then used to produce an appropriate alarm. Systems of this general type are available from manufacturers such as Checkpoint Systems, Inc., of Thorofare, N.J., among others.

Although such systems have proven effective in both security as well as inventory and process management, it has been found that certain improvements to such systems would be desirable. Perhaps foremost is the ever-present desire to reduce to the extent possible any errors (e.g., false alarms) which are produced by such systems, particularly in terms of their discrimination between the presence of a tag (signifying the presence of a protected article) and other interference which may be present in the vicinity of the electronic article surveillance system. Any steps which can be taken to improve the accuracy of the system will tend to reduce such undesirable results.

More recently, it has become of interest to provide an electronic article surveillance system with sufficient resolution to actually distinguish between different types of tags, resulting from differences in the resonant circuits which they contain. It has long been recognized that different types of tags have different "signatures" (responses) corresponding to the configuration of the resonant circuits which they contain. For example, the resonant circuit of a so-called "hard" tag will generally tend to produce a signal which is somewhat stronger than other types of tags, such as hang-tags and labels, resulting from differences in the size and configuration of the components which comprise these particular labeling devices. As a result, it becomes conceptually possible to differentiate between these various types of tags and labels by analyzing their signatures, by discriminating between the different signals which are possible.

However, to date, available systems did not possess the sensitivity to detect these differences in a reliable fashion.

SUMMARY OF THE INVENTION

It is therefore the primary object of the present invention to provide an electronic article surveillance system of improved accuracy and reliability.

It is also an object of the present invention to provide an electronic article surveillance system which can accurately and reliably react to an increased proportion and diversity of labels or tags which it may encounter.

It is also an object of the present invention to provide an electronic article surveillance system which can reliably discriminate between the signal produced by a tag passing in the vicinity of the electronic article surveillance system, and potential sources of interference.

It is also an object of the present invention to provide an electronic article surveillance system which can discriminate between different types of tags and labels.

It is also an object of the present invention to provide an electronic article surveillance system which can separately and adjustably address tags or labels according to desired operating parameters.

These and other objects are achieved in accordance with the present invention by providing the electronic article surveillance systems which were previously available with several different improvements which combine to achieve the above-stated goals.

For example, the transmitting antenna for the system now utilizes a "paired-lead" loop antenna configuration in place of the single-lead or single coaxial cable loop antennas of the prior art. The term "paired-lead" includes not only the twin-axial cable which is currently preferred for use but also other arrangements of two parallel leads, such as so-called "zip cords", paired coaxial cables and the like. Within each set of paired-leads, one lead forms an "active" antenna loop, i.e. one which is driven by the transmitter circuitry, in the case of the transmitting antenna, and which drives the receiver circuitry in the case of the receiving antenna. The other lead forms a "passive" loop, i.e. one which is not driven or driving, but rather interacts with the respective active loop only through mutual coupling between them. The passive loop can then be appropriately passively loaded, and the combination of active and passive loop will then exhibit the desired flattened amplitude and linearized phase response. However, this beneficial effect will be obtained without substantially detracting from the efficiency of the antenna which is so configured. In addition, one of the paired leads, preferably the passive one, can supply energizing signals from the receiver circuitry to the alarm devices of the system (e.g., warning light or buzzer), whenever a tag is detected.

The receiver for the system is provided with improved means for detecting signals resulting from tags or labels passing in the vicinity of the receiving antenna, including improvements in its filtering and processing sections. A linear phase (constant group delay) filter is used to more effectively preserve the signal which is received, and thereby improve the signal which is ultimately delivered to the processor which follows. The processor is provided with a "hysteresis-type" threshold detector which operates to further preserve the original signal by improving the shape (width) of the pulse which is ultimately delivered to the processor following conversion from analog form, and an adaptive processing routine which varies the subsequent processing of detected signals according to changes within the system (primarily resulting from changes and/or imperfections in the manner in which the tag or label is presented to the transmitting and receiving antennas), to improve the system's ability to discriminate between the different signals which are received by the unit.

These several improvements combine to provide an electronic article surveillance system which is capable of reliably identifying and discriminating between the different signatures of tags and labels which may come to pass in its vicinity, improving the reliability of the system and even permitting the tags and labels which may come to pass in the vicinity of the system to be classified by type, and separately addressed. Further detail regarding an electronic article surveillance system having these capabilities may be had with reference to the detailed description which is provided below, taken in conjunction with the following illustrations.

Figure 1:
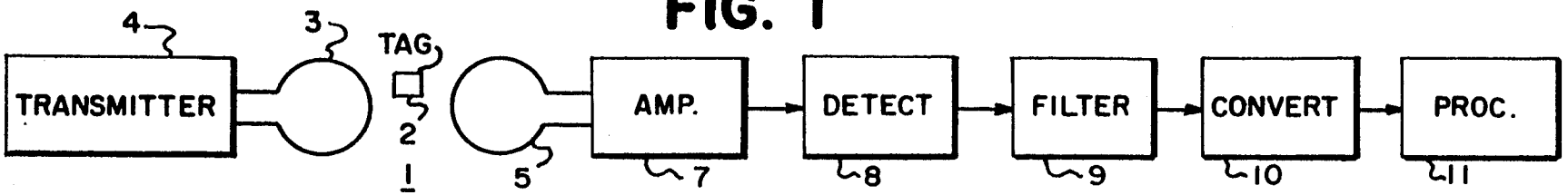
FIG. 1 is a block diagram of a conventional electronic article surveillance system.
Figure 6D:
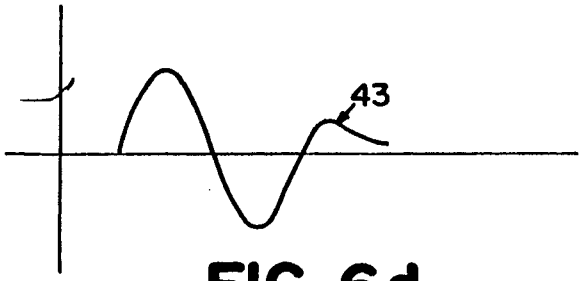

FIGS. *2a* and *2b* are diagrammatic plan views showing an improved antenna system for use in conjunction with the transmitting and receiving portions of the electronic article surveillance system of FIG. 1.

Figure 3:
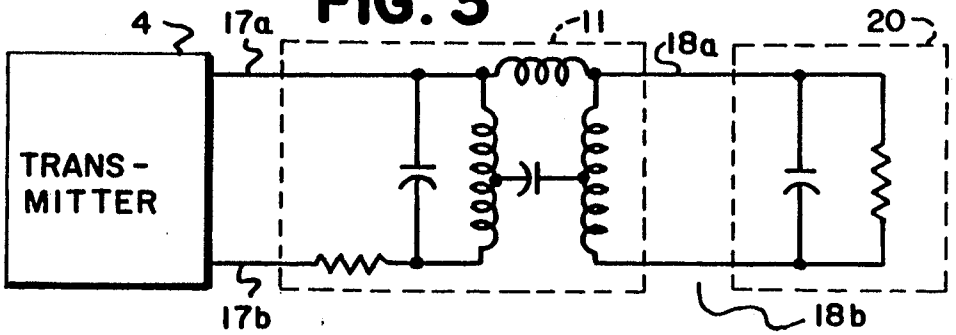

FIG. 3 is a schematic diagram of an equivalent circuit for the antenna systems shown in FIGS. *2a* and *2b*.

Figure 4:
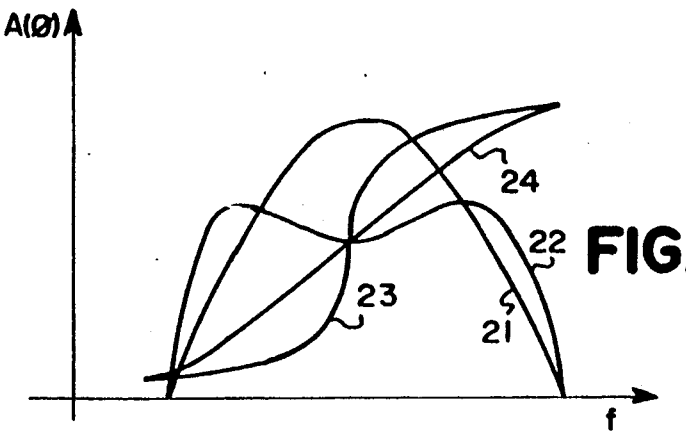

FIG. 4 is a graph which illustrates the frequency and phase response of the antenna systems shown in FIGS. *2a* and *2b*.

Figure 5:
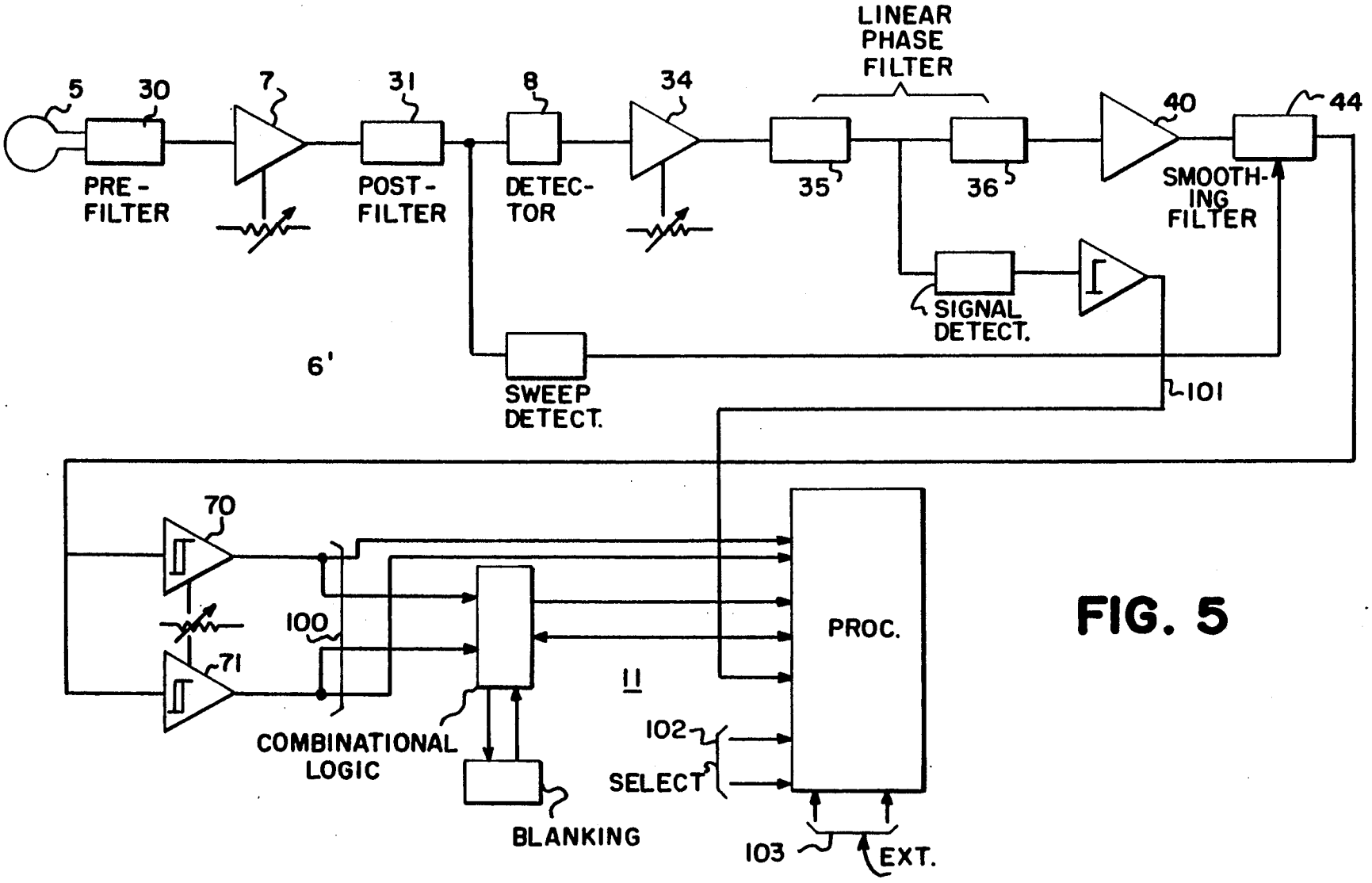

FIG. 5 is a schematic diagram of an improved receiver used in conjunction with the electronic article surveillance system of FIG. 1

FIG. 6 is a graph which illustrates the manner in which a received signal is processed by the receiver of FIG. 5.

FIGS. *7a–7d* are a graph which illustrates the manner in which the analog signals shown in FIG. 6 are converted to a digital representation presentation to the processor.

Figure 8:
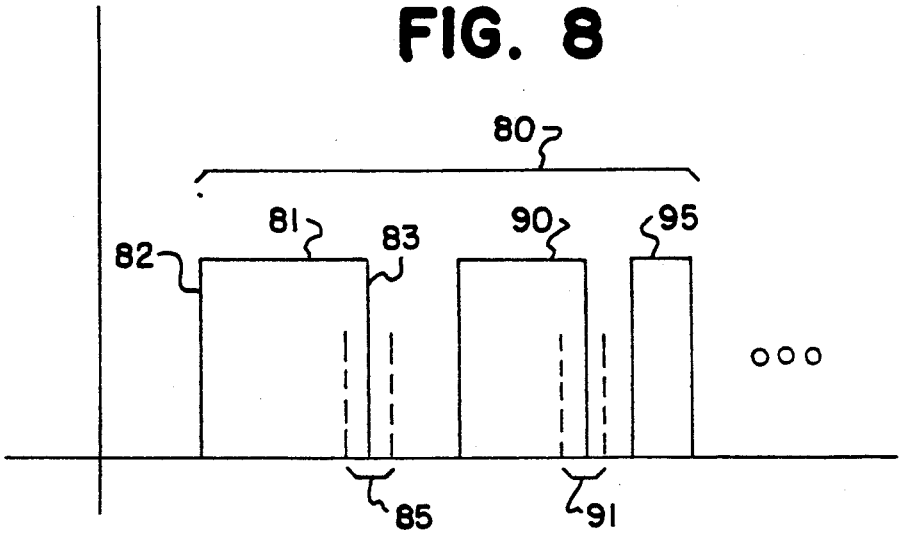

FIG. 8 is a graph which illustrates the manner in which the processor operates to discriminate between the various digital signals which are received.

Figure 9:
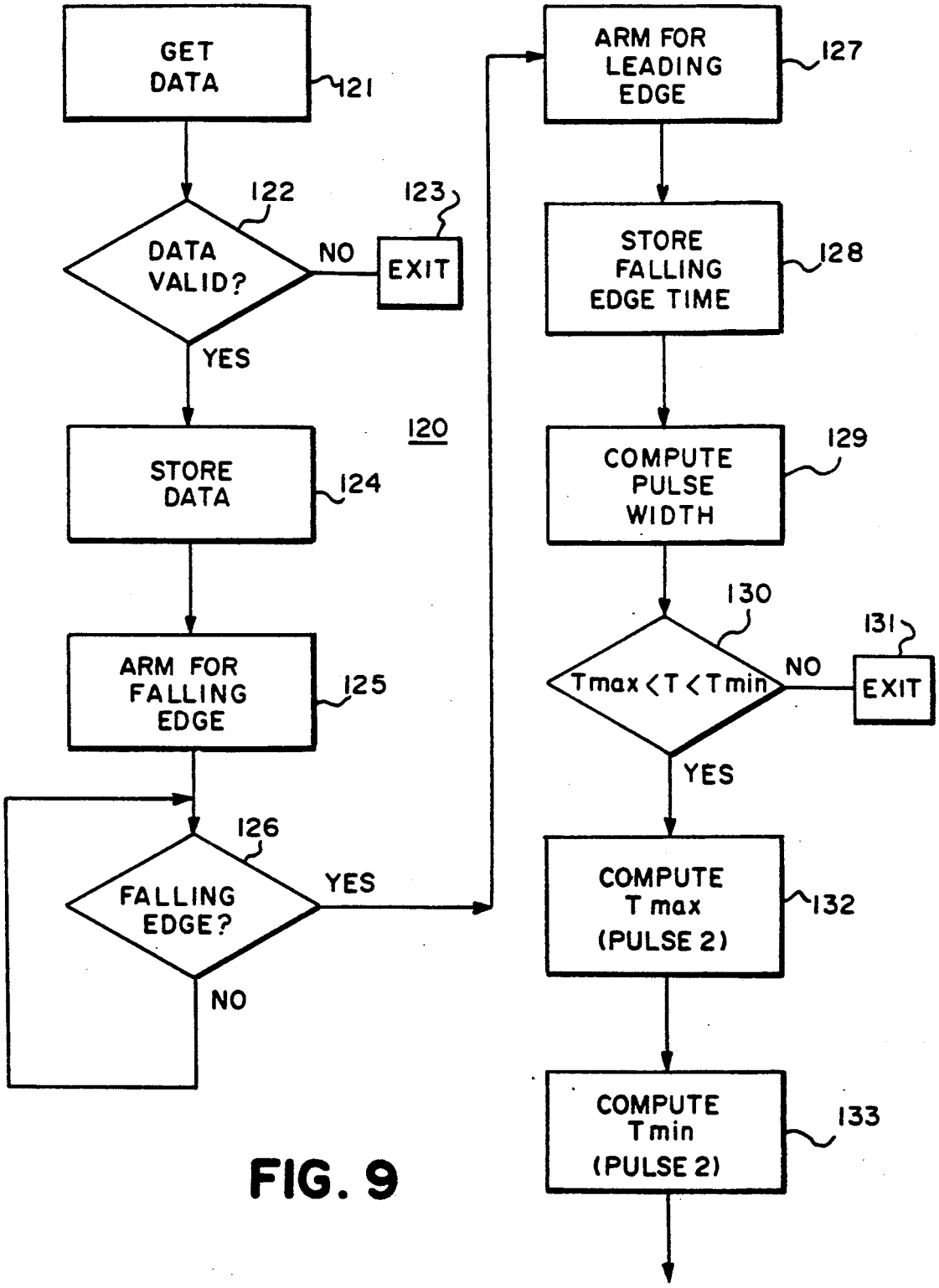

FIG. 9 is a flow chart which illustrate the manner in which the processor operates to perform pulse width comparisons in accordance with the present invention.

Figure 10:
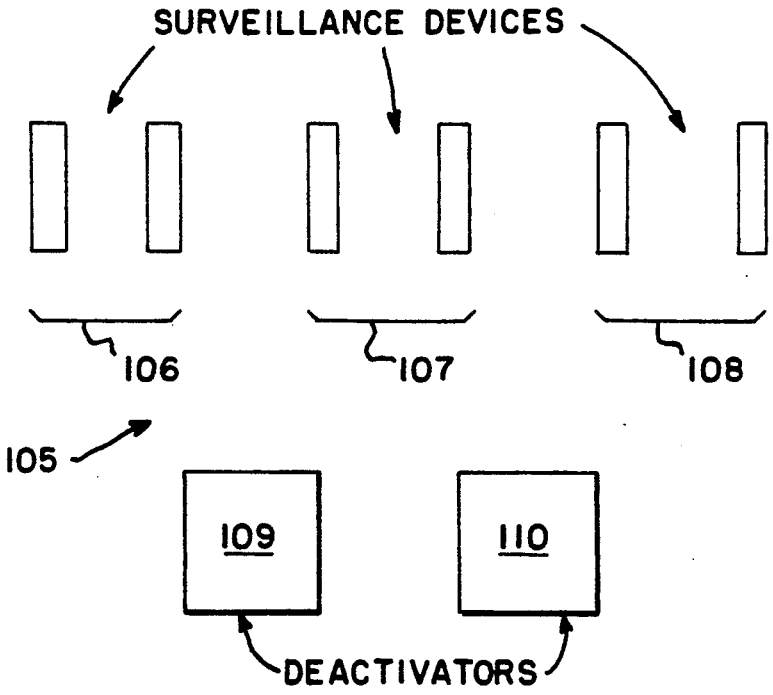

FIG. 10 is a schematic representation of a security system which incorporates a plurality of surveillance devices and supporting equipment in a single interactive environment.

In the several views provided, like reference numerals denote similar elements.

DETAILED DESCRIPTION OF THE PREFERRED EMBODIMENT

FIG. 1 shows (in block diagram form) what generally constitutes the conventional components of an electronic article surveillance system 1 of the type manufactured by and available from Checkpoint Systems, Inc., of Thorofare, N.J. This system 1 includes a tag 2 which can be applied to any of a variety of different articles in accordance with known techniques. For example, the tag 2 may take the form of a "hard" tag which is attachable to an article using the connecting pin with which this type of tag is generally provided. Alternatively, the tag 2 may take the form of a hang-tag which is appropriately tied to the article. The tag 2 may also take the form of a label adhesively affixed to the article. Any of a variety of types of tags and application techniques may be used to accomplish this general task.

Irrespective of the type of tag which is used, or its manner of attachment to the associated article, the tag 2 incorporates a resonant circuit (not shown) which is capable of reacting to applied fields of electromagnetic energy. A transmitting antenna 3 is provided which is capable of developing these applied fields responsive to the operation of associated transmitter circuitry 4. A receiving antenna 5 is provided for receiving electromagnetic energy both from the transmitting antenna 3 and the resonant circuit of the tag 2 to develop a signal which is in turn applied to a receiver 6. The receiver 6 then operates upon this detected signal to determine that the tag 2 is present in the vicinity of the transmitting and receiving antennas 3, 5, and give an alarm if such is the case.

This is generally accomplished by applying the signal which is picked up by the receiving antenna 5 to an amplifier 7, which operates to improve this received signal. The amplified signal is then applied to a detector 8 which essentially operates to recover (or demodulate) the active (base band) component which is used to detect the presence of a tag 2 in the vicinity of the electronic article surveillance system 1 from the high frequency (carrier) component of the signal which is required for use in conjunction with the transmitting and receiving antennas 3, 5. The base band signal which is isolated by the detector 8 is then applied to a filter 9 which operates to further attenuate undesirable low and high frequency signal components, including noise and other interference inherent in the isolated signal. The filtered signal is then applied to a converter 10 which operates to convert the analog signal received from the filter 9 to a digital signal which is suitable for presentation to a digital processor 11. Operations are then performed within the processor 11 to interpret the signal which is received, and to determine whether this received signal indicates the presence of a tag 2 in the vicinity of the transmitting antenna 3 and the receiving antenna 5, thereby representing a detectable event.

As previously indicated, and in accordance with the present invention, this otherwise conventional configuration is modified in various ways to improve the resolution of the resulting system, thereby improving its ability to differentiate between signals representative of a tag 2 passing near the transmitting antenna 3 and the receiving antenna 5, and other signals (noise, interference, etc.) which do not represent a properly detected event, and developing the ability to actually distinguish between different types of tags based upon differences in the signatures of the resonant circuits which they contain. This includes modifications to the transmitting antenna 3 and the receiving antenna 5, as well as modifications to the filter 9 and converter 10 which operate to provide signals to the processor 11, and the routine (software) which is employed to then process these received signals. Further detail regarding each of these improved components is provided below.

The transmitter circuitry 4 substantially corresponds in structure to the transmitters of prior electronic article surveillance systems of this general type. However, where possible, steps are taken to reduce distortion within the unit.

Figure 2A:
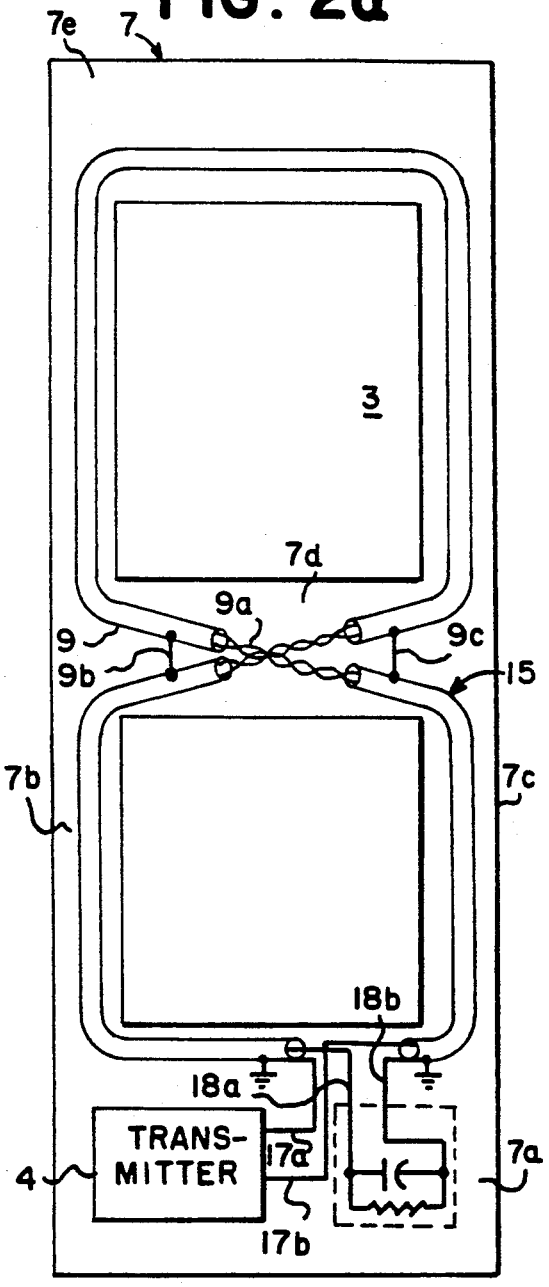
Figure 2B:
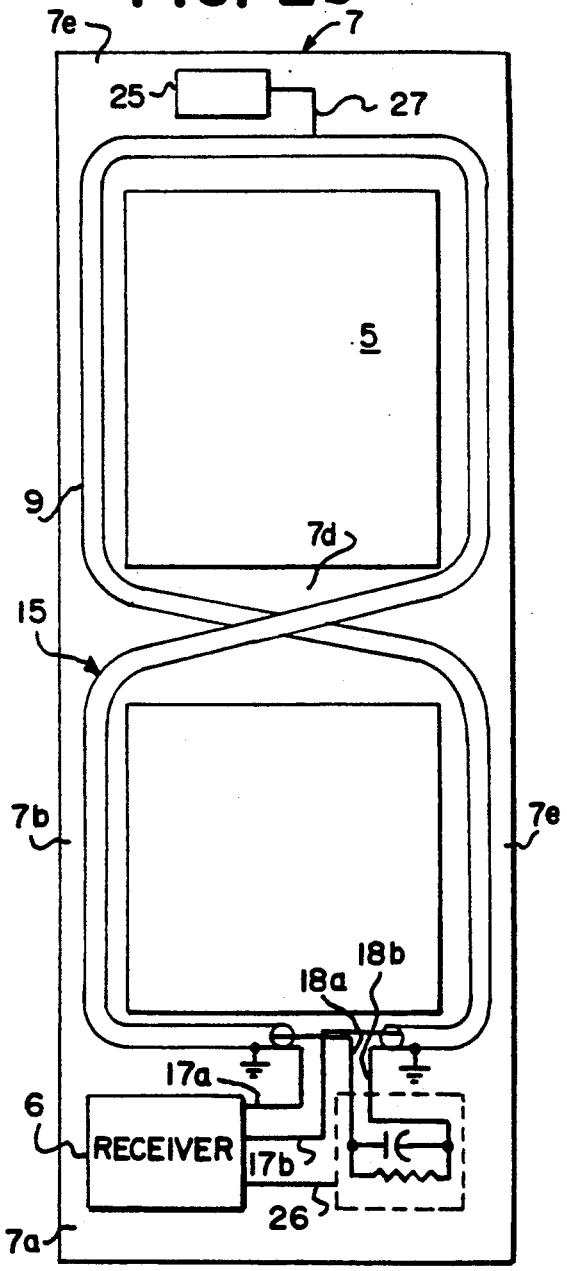

Referring now to FIGS. 2*a* and 2*b* of the drawings, these show the manner in which antennas embodying the present invention may be configured and mounted.

FIG. 2*a* shows this for the transmitting antenna 3, FIG. 2*b* for the receiving antenna 5.

In each case, there is provided a housing 7. In its presently preferred embodiment, this housing 7 is made of a hollow synthetic plastic body, in whose interior all the other elements are positioned. Specifically, in the base portion 7*a* of FIG. 2*a*, there is located the transmitter circuitry 4 (FIG. 1) while, in the base portion 7*a* of FIG. 2*b*, there is located the receiver circuitry 6 (FIG. 1).

Each housing 7 has a pair of uprights 7*b* and 7*c*, which are connected by cross-members 7*d* and 7*e*. In each housing 7, the antenna loop 15 starts at the base portion 7*a* and extends upwardly on one side of the loop into upright portion 7*b* and on the other side into upright portion 7*c*. However, at cross-member 7*d*, these sides of the antenna loop 15 change places, i.e. the portion extending along upright 7*b* switches over to upright 7*c* and vice-versa. The antenna loop 15 is then completed within cross-member 7*e*.

This crossing over of the upper and lower portions of each antenna loop 15 is what creates far-field cancellation of the antenna patterns, as appropriate to satisfy FCC regulations, as well as to reduce interference from remote sources of extraneous radio frequency energy. This technique of using one or more such cross-overs is known, and in itself, does not constitute an element of the present invention.

However, in accordance with the present invention, the antenna loop 15 is now formed of paired leads, which are preferably embodied in a twin-axial cable (a cable suitable for this purpose is available from Belden Wire and Cable Company, P.O. Box 1980, Richmond, Ind. 47375, under their product number 9271). Such a cable comprises an insulating sleeve, within which extends a pair of separate leads, surrounded by a conductive shield. A conductor for grounding the shield is also provided, and spacers are twisted in with the leads to maintain substantially uniform spacing of the elements within the outermost insulating sleeve.

It is also possible to make use of two discrete, generally parallel wires to form the antenna loop 15. Paired coaxial cables may also be used. In any case, the individual leads are preferably uniformly spaced from one another throughout their lengths. Further, it is preferable for the paired leads to be uniformly twisted along their lengths since this reduces the effect of local irregularities.

When using a shielded set of paired leads, as in the case of the twin-axial cable previously discussed, it is appropriate to provide a break in that shield, to assist the leads inside the shield in performing their basic function as antenna elements. Such a break is represented at 9*a* in FIG. 2*a*, where the leads inside shield 9 become exposed. To maintain electrical continuity for shield 9, the upper and lower portions separated by the break are conductively connected by conductors 9*b* and 9*c*. Although not illustrated, the same break arrangement is preferably provided for the antenna 5 of FIG. 2*b*.

In FIGS. 2*a* and 2*b*, the preferred twin-axial cable is represented somewhat diagrammatically by a tubular element 9 and by conductor pairs 17*a*, 17*b* and 18*a*, 18*b*, which are seen to emerge from the open lower ends of the element 9. Specifically, element 9 represents the conductive shield of the twin-axial cable; conductor pairs 17*a*, 17*b* and 18*a*, 18*b* represent the separate leads inside the cable, which become visible in FIGS. 2*a* and 2*b* where they emerge from the inside of shield 9, near the transmitter circuitry 4 and receiver circuitry 6, respectively.

More specifically, conductors 17*a* and 17*b* represents the so-emerging opposite ends of the same one of the two separate leads inside shield 9; conductors 18*a* and 18*b* represent the opposite ends of the second one of the two separate leads inside shield 9.

As shown in FIG. 2*a*, transmitter circuitry 4 is connected to that one lead whose emerging ends are designated by reference numerals 17*a*, 17*b* in FIG. 2*a*. This transmitting circuitry thus constitutes an "active" load for this lead and the loop which that lead forms inside shield 16 constitutes the "active" loop of the transmitting antenna.

In FIG. 2*b*, it is the receiver circuitry 6 which is connected to that one lead whose emerging ends are similarly designated by reference numerals 17*a*, 17*b* in FIG. 2*b*.

Accordingly, in FIG. 2*b*, it is the receiving circuitry which constitutes an "active" load for this lead and the loop which that lead forms inside shield 16 in FIG. 2*b* constitutes the "active" loop of the receiving antenna.

Turning now to the other lead inside each shield 9, the emerging ends of that lead, which are designated by reference numerals 18*a*, 18*b* in each of FIGS. 2*a* and 2*b*, are not connected to the respective active loads (namely to transmitter or receiver circuitry 4, 6). Rather the emerging portions 18*a*, 18*b* of these leads are connected in each of FIGS. 2*a* and 2*b* to a "passive" load 20 and the loop which each of these leads forms inside its shield 9 thus constitutes the "passive" loop of the respective antenna.

Each of these passive loops is in turn coupled to the active loop inside the same shield 9 by means of the mutual coupling which exists between two closely adjacent leads.

The impedance of passive load 20 is so chosen that, when it is reflected back into the respective active load through the above-mentioned mutual coupling, the overall effect will be to impart to each antenna loop 15 a much flatter amplitude response and a much more linear phase response than could otherwise have been obtained, without substantially reducing the antenna efficiency.

Because of the distributed nature of the mutual coupling between the leads inside each shield 9, it is difficult to provide a precise equivalent circuit for the arrangement. An approximation of such an equivalent circuit for the transmitter portion of the system is shown in FIG. 3 within the broken line rectangle designated by reference numeral 19.

As illustrated in FIG. 4, to which reference may now be made, the use of a second lead in the manner embodying the present invention changes the antenna amplitude response from one which is generally similar to that shown at 21 in FIG. 4, to one which is generally similar to that shown at 22, i.e. to one which is significantly more uniform throughout the operative frequency band. Also illustrated in FIG. 4 is a corresponding improvement in the antenna's phase response, from a response generally like that shown at 23, to a comparatively more linear response such as shown at 24.

By so flattening the antennas' amplitude response and linearizing their phase response, it becomes possible to effectively detect tag signals over a wider range of frequencies, without creating more false alarms. This is important because the resonant circuit which is part of each tag 2 tends to vary in resonant frequency from one tag to another. Because of this, conventional practice requires a swept frequency to be utilized by the system (e.g., 8.2 MHz±800 KHz) so as to effectively interact with such tags despite their variation in resonant frequency. Even then, some tags had to be rejected following their manufacture because they could not satisfy the tolerance requirements for the electronic article surveillance system with which they were to be used. By making it possible to effectively detect a broader range of frequencies, the electronic article surveillance system 1 of the present invention will operate to detect a wider range of resonant tags, in turn permitting a significantly reduced number of tags to be rejected in the course of their manufacture.

Using a twin-axial cable as the receiving antenna 5 provides an additional advantage for the system 1. It is the principal function of the receiver 6 to activate an appropriate alarm when the presence of a tag 2 is detected between the transmitting antenna 3 and the receiving antenna 5. To that end, there may be mounted inside the upper cross member *7e* of housing 7 in FIG. *2b* a conventional warning light arrangement diagrammatically represented by rectangle 25. In order to energize this warning light when required, a d-c connection needs to be provided between it and the receiver 6 located in the base *7a* of the housing 7. The passive lead (the one whose emerging ends are designated by reference numerals 18*a* and 18*b* in FIG. *2b*) may be used for that purpose. Specifically, d-c output from receiver 6 may be applied to that lead via a connection which is diagrammatically represented by lead 26 in FIG. *2b*. At the top of the loop formed by the twin-axial cable, a connection is made to the same passive lead near the warning light arrangement 25, as diagrammatically represented by connecting lead 27 in FIG. *2b*. As a result, there is no need for a separate, additional lead between receiver 6 and warning light 25. Potential adverse effects on antenna performance, resulting from the presence of such an additional lead, are thereby averted.

The result is a highly effective transmitting antenna 3 and receiving antenna 5 which are more uniformly responsive to signals received in the operating frequency range for the system. In addition to the effect of reducing the number of tags which must be rejected for being out of specification (thereby reducing waste), this has the further advantage of providing a relatively "clean" (distortion-free) signal to the improved receiver 6' of the present invention, which is more fully illustrated in FIG. 5 of the drawings, for further processing as follows.

Referring now to FIG. 6, the signal 28 which is received at the antenna 5 (FIG. *6a*) will primarily constitute a base band signal (e.g, 20 KHz) modulated upon the system's operating frequency (e.g., 8.2 MHz) and contained within an "envelope" corresponding to the intensity (amplitude) of the field which is then being received. The operative frequency (8.2 MHz) is preferably swept (±800 KHz approximately 82 times each second) to account for variations in the resonant circuits of the tags 2. When the tag 2 is caused to pass between the transmitting antenna 3 and the receiving antenna 5, a small deflection 29 will develop in this envelope, which must then be detected by the receiver 6' to provide an appropriate alarm signal. To be noted is that this deflection will occur in both phase and amplitude, but will be very small in magnitude (generally 1/1000 to 1/10000) in relation to the carrier signal. Careful detection techniques must therefore be used to isolate this signal, and then identify it, as follows, with reference to both FIG. 5 and FIG. 6 of the drawings.

The received wave form is first amplified (amplifier 7) and then introduced to the detector 8. This amplification may include a pre-filtering (at 30) and/or post-filtering (at 31) step, if desired. The detector 8 essentially operates to recover (demodulate) the base band (0–20 KHz) signal from its swept carrier (swept about a nominal 8.2 MHz) frequency. The resulting wave form (FIG. *6b*) will therefore substantially correspond to the isolated base band signal 32, with an added perturbation 33 which corresponds to the deflection 29 (change in amplitude and phase) produced by the presence of the tag 2 between the transmitting antenna 3 and the receiving antenna 5. To be noted is that this signal will tend to vary depending upon the location and orientation of the tag 2 relative to the antennas 3, 5, including variations in both the base band signal 32 and the detected perturbation 33. The resulting signal is preferably then amplified (amplifier 34) prior to introduction to the filter 9.

The filter 9 then operates to isolate the detected signal 32 from other signals which may come to be received by the antenna 5, such as the basic (8.2 MHz) carrier signal, other interfering signal (including signals received from the transmitter 4), and noise outside of the useful band. Preferably used for this purpose is a series combination of a high-pass filter 35 for eliminating undesired lower frequency components followed by a low-pass filter 36 for eliminating undesired higher frequency components.

It is a particular goal of the electronic article surveillance system 1 of the present invention to preserve those wave forms which are being processed through the system 1 responsive to a detected tag 2, to the extent possible. Filtering inherently tends to adversely affect such signals, not only in terms of their amplitude, but also by imparting time-delay distortion to the signals which are being processed. The amplitude of the resulting signal is preferably restored in an amplifier 40 which follows the filter 9. However, preservation of the original wave form remains compromised as a result of the encountered time-delay distortion.

Previously, and referring now to FIG. *6c*, such distortion had been compensated for by operating upon not only the primary signal 41 produced by a tag passing between the transmitting and receiving antennas of the system, but also one or more of the distortion products 42 produced by the filtering step. In accordance with the present invention, the filter 9 is presently configured as a linear phase (constant group delay) filter to avoid the adverse effects of time-delay distortion. Any of a variety of known linear phase filter configurations may be used for this purpose. The result is a filtered signal 43 (FIG. *6d*) which as closely as possible corresponds to the initial signal produced by the transmitter circuitry 4 and isolated by the detector 8 (FIG. *6b*). As will be further addressed below, this has significant advantages in connection with the subsequent processing which is to take place, contributing to the various improvements which are provided in accordance with the present invention. A smoothing filter 44 preferably follows the amplifier 40 to further remove noise components within the operating base band.

What is more, such filtering permits the received signal to be more effectively distinguished from that of the transmitter within a significantly lower frequency band, when the detected signal resulting from the presence of the tag 2 is exhibiting an increased magnitude from previously available systems. By way of explanation, and referring now to FIGS. 6*e* and 6*f*, the receiver 6' will operate to detect both a signal 45 from the transmitter 4 and a signal 46 from the tag 2 (including the signals and their harmonics). As shown in FIG. 6*e*, the tag signal 46 will not be easily distinguished from the transmitter signal 45 (which are of the same general type) until the frequency band 47 is reached. However, referring now to FIG. 6*f*, it is seen that the above-described filtering causes the transmitter signal 45' to roll off more rapidly than the tag signal 46', allowing the tag signal 46' to be differentiated from the transmitter signal 45' within the frequency band 48, where the tag signal 46' exhibits an increased magnitude. This operates to preserve more of the available tag signal 46' for further processing.

Figure 7A:
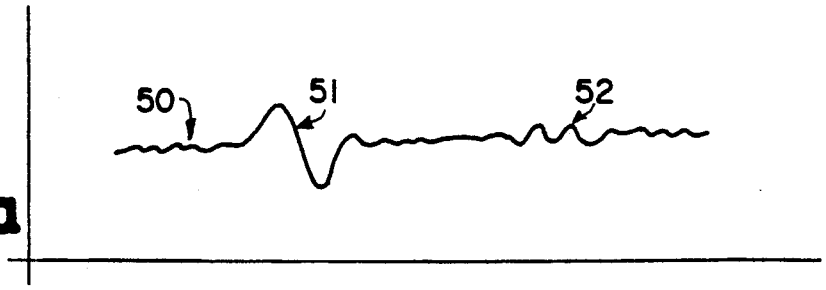

Referring now to FIG. 7, the filtered signal 50 shown in FIG. 7*a* (including responses 51 representing detected tags and responses 52 representing interfering signals) is then applied to the converter 10 to be converted from the analog signal which is received from the filter 9 to a digital signal which is appropriate for presentation to the processor 11. As with prior processors of this general type, the received analog signal is digitized to a one-bit resolution (a "one" or a "zero") since this has been found to provide sufficient resolution for interpretation by the processor 11. To be noted is that while this is presently preferred in view of its simplicity, it would be equally possible for higher resolution conversions to be used in conjunction with a multi-bit processor, if desired.

Figure 6C:
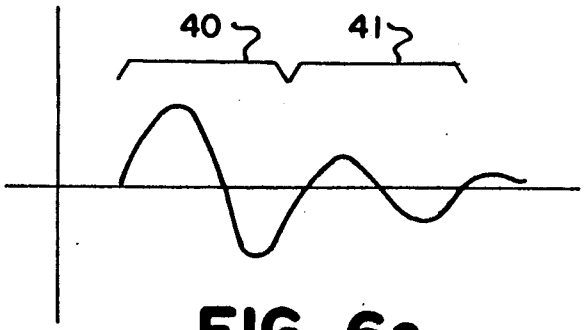
Figure 6A:
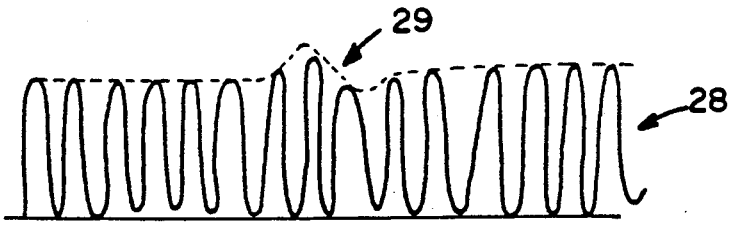
Figure 6B:
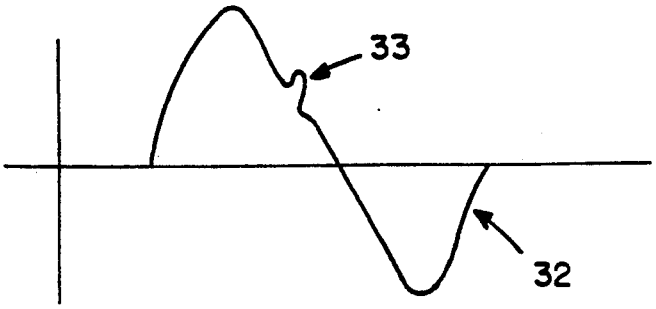
Figure 6E:
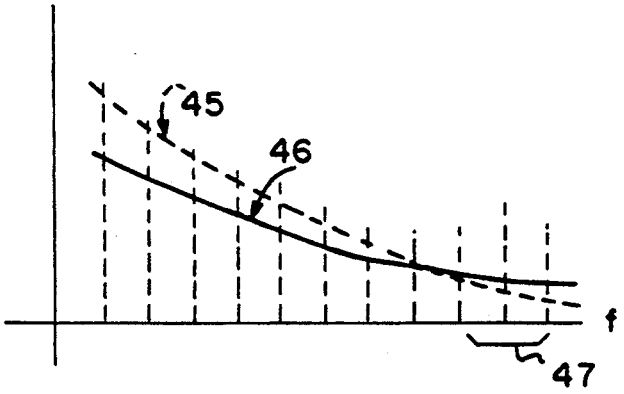
Figure 6F:
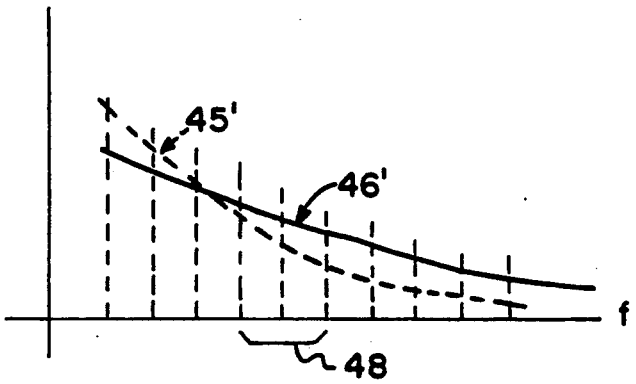
Figure 7B:
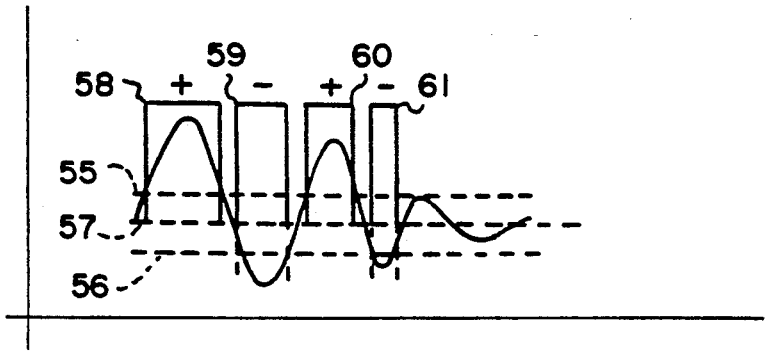
Figure 7C:
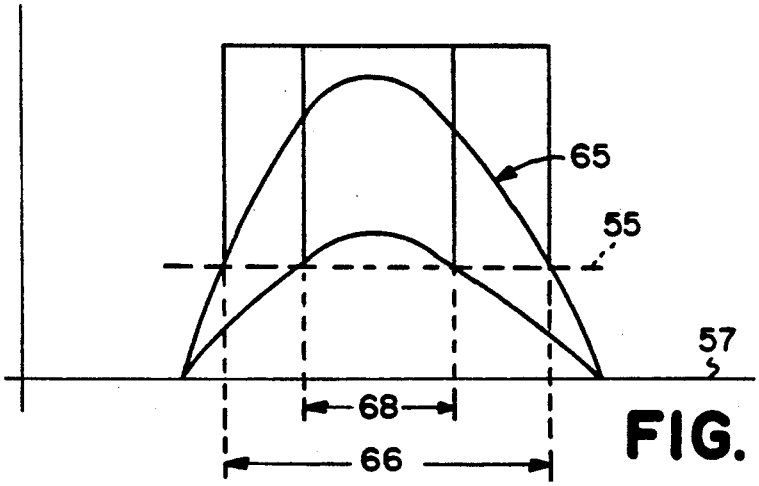
Figure 7D:
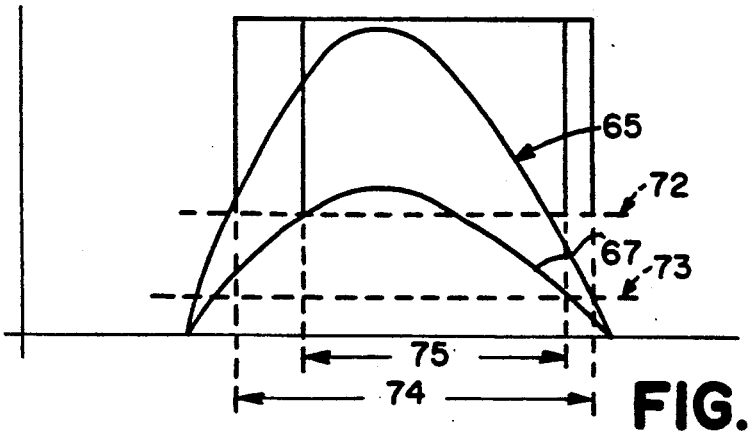

Referring now to FIG. 7*b*, such conversion was previously accomplished using a threshold detector which operated to detect levels exceeding certain selected thresholds 55, 56 centered about a pre-selected level 57, to produce desired transitions (forming pulses) according to variations in the level of the applied analog signal (developing a positive pulse for both positive-going and negative-going signals), in this case the tag signal of FIG. 6*c*. This in turn developed a series of positive pulses 58, 59, 60, 61 having pulse widths which would vary according to the analog signal which was then received from the filter 9. The widths of these resulting pulses defined the "signature" for a particular tag 2 detected between the transmitting antenna 3 and the receiving antenna 5. Other pulses would also be developed resulting from other signals, particularly interference in the vicinity of the electronic article surveillance system. However, since these additional pulses had characteristics (widths) which differed from the signature of the tag 2 which was being searched for, it was possible for the processor of the system to determine whether a particular series of pulses corresponded to the signature (pattern) of a tag 2, or an interfering signal.

As previously indicated, a broader range of signals for enabling this determination to proceed will be made available by the transmitter and receiver components which have earlier been described, as well as the associated transmitting antenna 3 and receiving antenna 5, which cooperate to better preserve the signals which are to be operated upon. However, even with these improvements, it was found that the techniques which were employed by previous processors to make such a determination were still generally insufficient to distinguish between these various pulses with sufficient particularity for the processor 11 to be able to discriminate between different signatures corresponding to different types of tags, in addition to its primary function of distinguishing between tag signatures and interfering signals.

The primary reason for this arises from certain considerations relating to the tag 2 which is then being passed between the transmitting antenna 3 and receiving antenna 5. As is the case with any tag, and particularly in connection with an unauthorized removal of an article, it can be expected that tee tag 2 will not always be placed in an optimum position relative to the transmitting antenna 3 and the receiving antenna 5 to produce a maximized signal at the receiving antenna (i.e., generally parallel to the plane of the transmitting antenna 3 and the receiving antenna 5). Rather, it can be expected that the tags will come to be placed at different angles relative to the antennas 3, 5.

As a result, signals of different quality will often come to be applied to the converter 10, producing widely different signals for interpretation by the processor 11. For example, and referring now to FIG. 7*c* (somewhat expanded in scale for illustrative purposes), a signal 65 of relative strength will tend to cross the selected threshold 55 rather quickly, and will return to that selected threshold rather late, developing a relatively wide pulse 66. However, a signal 67 of reduced strength will more rapidly reach and return to the selected threshold 55, producing a pulse 68 of significantly reduced width. This has been found to complicate, and often compromise the signal processing steps which are to follow.

The technique which is generally used to distinguish between pulses which correspond to the signature of a tag and pulses which correspond to an interfering signal is to determine whether the received pulse has a duration (width) which falls within a predefined "window". This window is established (set) within the processor 11 and must be broadly defined to accommodate not only the variety of different tag configurations which can be anticipated, but also the broad spectrum of detected pulses which might correspond to an interfering signal. As a result, it was not possible for such systems to distinguish between different types of tags (and their signatures), and it was not uncommon for these systems to fail to distinguish a valid pulse of reduced width (i.e., the pulse 68) from a source of interference, failing to detect the presence of a tag 2 between the antennas 3, 5. Broadening the defined window would help the system to recognize a greater number of tags. However, this has the corresponding disadvantage of also identifying and accepting a greater number of interfering signals as the presence of a tag, leading to an increased number of false alarms. This generally necessitated the striking of a balance which was at times less than optimum.

In accordance with the present invention, various steps are taken within the converter 10 and the processor 11 to improve the overall detection process, and to more carefully distinguish between the signature of a tag and other signals which may come to be received in the course of operating the electronic article surveillance system 1.

The first of these improvements forms part of the converter 10, and relates to the manner in which the initial threshold comparisons are made. Specifically, a "hysteresis-type" threshold comparison is made, making use of two different thresholds (developed by the two different comparator circuits 70, 71 of FIG. 5) which are selected to define (detect) the leading and trailing edges of the converted pulse, respectively. Referring now to FIG. *7d*, by properly selecting the two different thresholds 72, 73, the same initial signals 65, 67 which are shown in FIG. *7c* will result in pulses 74, 75 which are significantly closer in proportion to one another than were the pulses 66, 68. As a result, the pulses 74, 75 constitute a more accurate representation of the initial signal. This applies not only to the stronger signals, but also to the signals of reduced strength, which operates to significantly expand upon the range of signals which are effectively detectable by the converter 10. for subsequent processing.

Selection of the two different thresholds 72, 73 is made according to the particular signature (characteristics) of the tag 2 which is to be operated upon, as well as the anticipated environment for the system. Consequently, these levels are preferably made adjustable to accomodate different applications. This may include both adjustments in relative level (i.e., upper and lower thresholds varied as a pair) as well as adjustments in the difference between the two selected thresholds, as desired. It is even possible to adjust the thresholds 72, 73 so that one is positive while the other is negative, should this be indicated for a particular application.

Referring now to FIG. 8 of the drawings, this improved signal is in turn applied to the processor 11, which incorporates additional improvements for further discriminating between tag signatures and interference, as follows. As is conventional, following the detection of a leading edge 82 of a first pulse 81 resulting from a detected signal 80 (either a tag signature as illustrated, or an interfering signal), steps are taken to determine whether that pulse's trailing edge 83 falls within a predefined window 85 established for the anticipated pulse width of a desired tag signature. If so, steps are then taken to analyze the next pulse 90 in the detected series 80.

Previously, this was accomplished by similarly comparing the width of the second pulse 90 with a pre-established (fixed) window for that pulse. However, in accordance with the present invention, this prior technique is replaced with an analysis of the second pulse 90 according to a variable window 91 which is "redefined" (computed and adjusted) according to a routine established within the processor 11. The computational adjustment which is made is based upon the analysis of the first pulse 81 in the series 80, and certain assumptions which are made regarding the anticipated characteristics of the second pulse 90 which is to follow. If the second pulse 90 is then determined to constitute the signature of a tag 2, a counter (conventionally provided in software within the processor 11) is incremented as before. However, to be noted is that this incrementing is performed after only two pulses 81, 90 have been successfully analyzed, as distinguished from the prior systems which would generally require a third pulse 95 of the detected signal 80 to be analyzed before this determination could be made.

FIG. 9 shows the manner in which the pulses 81, 90 are analyzed within the processor 11, in somewhat greater detail. To initiate this routine 120, data (magnitude and polarity) corresponding to the detected signal 80 is obtained, at 121. This obtained data is then tested, at 122, to ensure that valid data has been obtained. If not, the routine 120 is exited, at 123. Otherwise, steps are taken to store the obtained data, at 124. This includes storage of the polarity of the detected signal, and an indication of the time (measured against a clock signal) corresponding to the leading edge of the first pulse 81 of the series of pulses forming the detected signal 80.

Steps are then taken, at 125, to advise the routine 12 of the polarity of the first pulse 81 (which is then under test) to enable the falling edge of the first pulse 81 to be detected. Steps are then taken to periodically monitor the detected signal 80, at 126, to search for the falling edge of the first pulse 81.

Upon detection of the falling edge of the first pulse 81, steps are then taken to search for the leading edge of the second pulse 90. To this end, steps are taken to initialize the routine 120, at 127, in accordance with the polarity of the second pulse 90 which is to follow. Steps are also taken to store the time (measured against the clock signal) for the falling edge of the first pulse 81, at 128. Thereafter, the width of the pulse under test is computed, at 129, by subtracting the leading edge time stored at 124 from the falling edge time stored at 128. A test is then made, at 130, to verify that the pulse width calculated at 129 falls within the pre-established (fixed) window 85 for the first pulse 81. If not the routine 120 is exited, at 131.

In the event that the width of the first pulse 81 falls within its prescribed window, steps are then taken to define the window 91 which is used to monitor the second pulse 90 of the detected signal 80. Such definition is achieved by calculations at 132, 133, which will vary in accordance with the width of the first pulse 81. To this end, a maximum value is calculated ($180 \times$ clock + width of pulse 81) at 132, and a minimum value is calculated ($10 \times$ clock + width of pulse 81) at 133.

Thereafter, steps are taken to obtain further data, and to proceed through a routine similar to that illustrated in FIG. 9, from 121 to 130. However, in this case, the test performed at 130 will proceed making use of the calculated maximum and minimum pulse widths developed at 132 and 133, in place of the fixed (pre-established) values originally used to test the first pulse 81 (at 130).

As previously indicated, electronic article surveillance systems of this general type are configured to repeatly sweep about the nominal operating frequency of the system, thereby developing repeated signals corresponding to the presence of a tag 2 between the antennas 3, 5. This in turn produces plural signatures which must then be detected by the processor 11, in similar fashion. In addition to making a determination as to whether or not a subsequently received signal corresponds to the signature of a tag 2 or some other signal (i.e., interference), as described above, steps are also taken to determine whether or not the detected signal corresponds in time to a scheduled sweep by the transmitter circuitry 4. If an identified signature is detected during a scheduled sweep of the system, steps are again taken to increment the system's counter. Otherwise, a spurious signal is deemed to exist and that signal is ignored.

In prior systems, this continued until the counter reached a selected number (e.g., six or seven counts), when a tag 2 would be deemed to be present and an alarm sounded. However, when a tag 2 passes through the electromagnetic field which is produced by the system, it is often the case that the relationship between the field (flux) which is produced and the resonant circuit of the tag 2 which is moving through that field will vary. This would in turn cause variations in the tag signals (primarily in magnitude) which were detected responsive to successive sweeps of the transmitter circuitry, which at times prevented an effective recognition of a tag signature by the processor 11. The improvements described in connection with the electronic article surveillance system 1 of the present invention operate to improve the reliability of this detection process. However, it is still possible for tag signatures to go undetected. It is for this reason that there is yet another improvement which is incorporated into the processor 11.

Specifically, it was previously the practice to reset the counter to zero if an anticipated tag signature was not detected during a scheduled sweep of the system, prior to reaching the designated count. This was done to avoid false alarms and the like, but could also result in the failure to detect a tag 2. In accordance with the present invention, this technique is replaced with an up/down counter (within the processor 11) which operates to track both successfully detected signatures, and other events, responsive to periodic sweeps of the transmitter. To this end, if a tag signature is detected, and if the detected signature occurs following a scheduled sweep (within a defined window), the counter is incremented. Detected events occurring outside of the windows defined for the swept signal are ignored. If no tag signature is detected within the prescribed window, the counter is decremented. This continues until such time as the counter either reaches a prescribed threshold (e.g., five counts) or returns to zero (no tag present), significantly diminishing the effects of undetected signatures. To be noted is that a variety of different counts may be selected for use in this regard. For example, it is possible for an increment to result in an increase of one, or more than one. Similarly, a decrement may correspond to one, or some greater number. The count established for an increment may be the same as that established for a decrement (i.e., one to one), or different counts may be used, as desired in a particular application.

Referring again to FIG. 5, a system for providing these functions generally comprises a processor 11 which receives its primary signal 100 from the dual threshold detectors 70, 71, and appropriate controlling signals from an external signal detector 101 which precedes the linear phase filter 9 (which provides a logic level for timing purposes), and is provided with the computer program listing which follows this specification (Appendix). If desired, the processor 11 is additionally controllable (programmable) at 102 to vary the window which is used to analyze the first pulse of a received signal (subsequent pulses are analyzed according to computationally adjusted windows as previously described).

To be noted is that the processor 11 can also be controlled, at 103, to change the sweep rate of the electronic article surveillance system 1 from the previously described rate of 82 Hz to a different sweep rate if desired. This permits the electronic article surveillance system 1 to separately address tags using different sweep rates, for reasons which are best illustrated with reference to FIG. 10.

In practice, it is not uncommon for a complete security system 105 to employ a plurality of electronic article surveillance devices 106, 107, 108, in addition to other support equipment such as tag deactivators 109, 110 and the like. In many cases, these structures must be positioned relatively close to one another, which can give rise to interference between these various devices. Such interference results from operating each of the several units at the same basic frequency. Small differences in these operating frequencies (resulting from design tolerances and the like), or their sychronization, can produce beat patterns which at times generate false alarms and other spurious signals.

Previously, this was accommodated by sychronizing the several units employed to one master unit (e.g., synchronizing the devices 106, 107 and the deactivators 109, 110 to the device 108), thereby avoiding interference between the various units employed. However, this often complicated the installation of such systems, in view of the wires which needed to be run between the several units, and could also at times produce unacceptable interference on such connecting wires (which would themselves tend to act as antennas producing interfering signals). In any event, when initially installing a security system of this general type, it was necessary to very carefully adjust (tune) the various components of that system to reduce the foregoing problems to the extent possible. At times, it was even necessary to readjust the various components of the system, to maintain this careful balance.

In accordance with the present invention, the need for such special measures is eliminated by causing each of the several components which comprise the installed system to operate at different sweep rates, thus avoiding the potential for interference between these respective components. For example, the devices 106, 107, 108 could be operated at three different sweep rates, with the deactivators 109, 110 operating at a fourth and different sweep rate (it is not necessary for the deactivators to operate at different rates so long as their rate of operation differs from those of the accompanying electronic article surveillance devices). Due to the programmability of the processor 11, this improvement in system operation is achieved in a straightforward manner which can be tailored to particular applications, as desired.

To be noted is that the different sweep rates which are used can be selected, as desired, although it is presently considered important to maintain the selected sweep rates above 70 Hz and below 90 Hz to avoid impairment of the system's overall function, and to separate the selected sweep rates by at least 3 Hz to permit the system to distinguish between the sweep rates which are available.

These above-described adjustments can either be incorporated into the system by pre-established programming of the processor 11, if desired, or by switchably selecting between them according to the particular application which is needed. This would include both the selection of basic sweep rate for the system, as well as the selection of window parameters for detecting tag signatures.

Accordingly, it is seen that a variety of improvements are combined in accordance with the present invention to significantly reduce distortions within the system, to better preserve the basic signals which are developed responsive to the presence of a tag, and to more effectively interpret the signals which result. This includes not only the careful design of various components to reduce distortion, but also the specific improvements of the present invention including the improved configurations for the transmitting antenna 3 and the receiving antenna 5, the improved configuration for the filter 9 and the converter 10, and the improved processing routines which are performed within the processor 11. The result is a system which not only improves the differentiation of tag signals from other interfering signals, but which is sufficiently sensitive to even permit a discrimination between different tag signatures.

Such improved discrimination gives rise to capabilities which were not achievable with previously available electronic article surveillance systems. For example, it now becomes possible to actually discriminate between different types of tags, permitting a classification of tag groups according to their signature (characteristics). This can be used to better match the electronic article surveillance system 1 to the particular tag which is to be used, to achieve a more error-free result, or to distinguish between different types of tags used with the electronic article surveillance system 1. This can also be used to change the sweep rate used in conjunction with operation of the electronic article surveillance system 1, to avoid interference with adjacent components. What is more, these functions are easily varied by adjusting (programming) the parameters to be used within the processor 11, as previously described.

It will therefore be understood that various changes in the details, materials and arrangement of parts which have been herein described and illustrated in order to explain the nature of this invention may be made by those skilled in the art within the principle and scope of the invention as expressed in the following claims.

APPENDIX

```
;*****************************************************************
;
;       PROGRAM FOR 63(A/B)01/637(A/B)01VOC MICROPROCESSOR IN ALPHA RECEIVER
;                          ( 6 MHZ Resonator)
;                  ( Fixed sweep rate selects)
;                 ( Panasonic smoothing filter )
;
;*****************************************************************


;*********************      VER. 1.2A     ********************************


;******************** PORT DEFINITIONS ******************************

;       MICRO IS SET UP IN MODE 7  (SINGLE CHIP)

;                          PORT 1
;    P17      P16      P15      P14    P13   P12   P11    P10

;   MSB Pgm Sel LSB  Alm Time Alm Src  (+)   (-)   J1a    J1b
;    in       in       in       in     in-   in-   swpsel in
;                                                  LSB   MSB
;

;                          PORT 2

;    P27  P26  P25    P24      P23    P22   P21     P20

;    ---- N/U -----------    Video En            ICR(Video)
;                                     ---- Mode Set ----
;                            out-    in   in      in-


;                          PORT 4

;    P47    P46     P45   P44     P43      P42   P41     P40

;    TP5    TP4     P.S.  PS En  Ext Inh   Alm  Almflg   ---
;    out    out     in-   in       in      out   out-
```

```
;*****************************************************************
;
;                              EQUATE TABLE
;
;*****************************************************************

p1ddr          equ     00h
p2ddr          equ     01h
p1data         equ     02h
p2data         equ     03h
p4ddr          equ     05h
p4data         equ     07h
stacktop       equ     0ffh
romstart       equ     0f000h
ramstart       equ     40h
ramstop        equ     0ffh

pstmax         equ     45

tcsr           equ     08h
ocr            equ     0bh
beeptime       equ     9c000h
icr            equ     0dh
timer          equ     09h
twoffset       equ     1200
onesec         equ     22              ;one sec. timer
fivsec         equ     112             ;five sec. timer
maskon         equ     02h
swp78          equ     19220
swp82          equ     18290
swp86          equ     17440
swp90          equ     16670
swpmin78               equ     19480
swpmin82               equ     18520
swpmin86               equ     17650
swpmin90               equ     16850
swpmax78               equ     18990
swpmax82               equ     18070
swpmax86               equ     17240
swpmax90               equ     16480
swpadj78               equ     20
swpadj82               equ     0
swpadj86               equ     -20
swpadj90               equ     -35

;*****************************************************************
;
;                              MICRO SETUP
;
;       The 6301 is configured in a mode 7 status as follows:
;
;       1. Internal RAM from 40h to FFh
;
;       2. Internal ROM from F000h to FFFFh
;
;       3. NMI tied to ground
;
;       4. IRQ line tied to beat note detection ckt-
;
```

```
;       5. Output (P41) used for Alarm Level
;
;       6. Timer input (P20) used for +thresh ored -thresh input
;
;       7. P42 is output used for Sonalert and lamp driver
;
;    8. P10/P11 (J1) select sweep rate parameters
;
;*****************************************************************

                org     ramstart

status          ds      1
signflg         ds      1
tlead           ds      2
tfall           ds      2
tend                    ds      2
temp                    ds      2
tlimits         ds      4
pcnt                    ds      1
vflag           ds      1
almenflg                ds      1
pstimflg                ds      1
pstimer         ds      1
almcntr         ds      1
window1         ds      2
window2         ds      2
tpcnt           ds      1
time95          ds      2
almflg          ds      1
tmark           ds      2
tagcnt          ds      1
srchflg         ds      1
vcnt                    ds      1
atimer          ds      1
atimflg         ds      1
rtclk           ds      1
tripcnt         ds      1
tdetlim         ds      4
tdrop           ds      2
tbuff           ds      2
bniflg          ds      1
inhflg          ds      1
swptime         ds      2
swpmin          ds      2
swpmax          ds      2
baslimit                ds      4


;*****************************************************************
;                       Initialization Procedure
;*****************************************************************


                org     romstart

reset           ldaa    #00000000b      ;init i/o port 1
                        staa    piddr
                        ldaa    #00000000b
                        staa    pldata
```

```
                ldaa    #00001000b      ;init i/o port 2
                staa    p2ddr
                ldaa    #00001000b      ;disable composite video
                staa    p2data
                ldaa    #11000110b              ;init i/o port 4
                staa    p4ddr
                ldaa    #00000000b
                staa    p4data
                lds     #stacktop               ;init top of stack

ramchk          ldx     #ramstart               ;write / read ram
                ldaa    #0aah
ramlp1          staa    0,x
                cmpa    0,x
                bne     ramerror
                inx
                        +1
                cpx     #ramstop
                bne     ramlp1
                ldx     #ramstart
                ldaa    #55h
ramlp2          staa    0,x
                cmpa    0,x
                bne     ramerror
                inx
                cpx     #ramstop+1
                bne     ramlp2
                bra     ramok
ramerror        ldaa    #01h            ;set bit 0 of status
                staa    status
                bra     romchk
ramok           clr     status  ;reset bit 0

romchk          ldx     #romstart       ;compare rom chksum
                clra
romlp           adda    0,x
                inx
                bne     romlp
                tsta
                beq     romok
                ldaa    #02h            ;set bit 1 of status
                oraa    status
                bra     romexit
romok           ldaa    #0fdh   ;clear bit 1
                anda    status
romexit         staa    status

iochk           ldaa    p2data  ;get levels on port 2
                anda    #00001111b
                cmpa    #00001111b      ;normal reset levels
                bne     ioerror
                ldaa    p4data          ;get port4 levels
                anda    #11000110b
                cmpa    #00000000b
                bne     ioerror
                bra     io_ok
ioerror         ldaa    status          ;update status byte
                oraa    #04h            ;set bit 2 of status
                bra     ioexit
```

```
io_ok       ldaa    status  ;clear bit 2
                    anda    #0fbh
ioexit      staa    status

beepcode            ldaa    status  ;get status code
                    anda    #07h
                    beq     nofault
                    bita    #01h            ;test ram bit
                    bne rambeep
                    bita #02h               ;test rom bit
                    bne     rombeep
                    bita    #04h            ;test i/o bit
                    bne     iobeep
nofault     ldab    #1
                    bra     beep
rambeep     ldab    #2
                    bra     beep
rombeep     ldab    #3
                    bra     beep
iobeep      ldab    #4
                    bra     beep
beep                ldaa    p4data  ~~;alarms on~~ ;alarms on
                    oraa    #06h
                    staa    p4data
                    ldaa    #2
                    bsr     bdelay
                    ldaa    p4data  ;alarm off
                    anda    #0f9h
                    staa    p4data
                    ldaa    #3
                    bsr     bdelay
                    decb
                    bne     beep
                    bra     rnext
bdelay      ldx     #0c000h
bipl                dex
                    bne     bipl
                    deca
                    bne     bdelay
                    rts

rnext       ldaa    #2                      ;init tdet counter
                    staa    pcnt
                    clr     pstimflg
                    clr     vcnt
                    clr     vflag
                    clr     almenflg
                    clr     srchflg
                    clr     tagcnt
                    clr     alaflg
                    clr     pstimer
                    clr     almcntr
                    clr     rtclk
                    clr     atimflg
                    clr     atimer
                    clr     bniflg
                    clr     inhflg
                    ldd     timer   ;init valid reply timers
                    std     tend
                    std     tmark
```

```
;*****************************************************************
;                Read target type selector switches
;*****************************************************************


option      ldaa    pldata          ;read option jumper
                    anda    #0c0h
                    bne     j1
            ldx     #t1limits               ;get t1 pulse limits
                    ldd     0,x
                    std     baslimit
                    ldd     2,x
                    std     baslimit+2
                    ldaa    #5
                    staa    tripcnt
                    bra     rlast

j1                  cmpa    #40h
                    bne     j2
            ldx     #t3limits               ;get t1 pulse limits
                    ldd     0,x
                    std     baslimit
                    ldd     2,x
                    std     baslimit+2
                    ldaa    #5
                    staa    tripcnt
                    bra     rlast

j2                  cmpa    #80h
                    bne     j3
            ldx     #t2limits               ;get t1 pulse limits
                    ldd     0,x
                    std     baslimit
                    ldd     2,x
                    std     baslimit+2
                    ldaa    #5
                    staa    tripcnt
                    bra     rlast

j3          ldx     #t4limits               ;get t1 pulse limits
                    ldd     0,x
                    std     baslimit
                    ldd     2,x
                    std     baslimit+2
                    ldaa    #5
                    staa    tripcnt
                    bra     rlast

rlast       ldd     baslimit                ;initialize time windows
                    std     tdetlim
                    ldd     baslimit+2
                    std     tdetlim+2

                    ldx     #swptbl         ;init sweep rate windows
                    ldd     0,x
                    std     swptime
                    ldab    #8
                    abx
                    ldd     0,x
```

```
                std     swpmin
                ldab    #8
                abx
                ldd     0,x
                std     swpmax

                ldaa    tcsr            ;enable oci, iedg (-)
                anda    #11111101b
                oraa    #00011000b
                staa    tcsr

                ldaa    p2data  ;enable composite video
                anda    #0f7h
                staa    p2data
                cli
                jmp     main

;*****************************************************************
;               Main Routine
;*****************************************************************


main            ldx     #swptbl ;get J1 position and
                ldab    p1data  ;convert to sweep rate data
                andb    #03h
                aslb
                abx
                ldd     0,x             ;get sweep period
                std     swptime
                ldab    #8              ;get min. sweep time
                abx
                ldd     0,x
                std     swpmin
                ldab    #8              ;get max. sweep time
                abx
                ldd     0,x
                std     swpmax

;*****************************************************************
;       Adjust timing windows for selected sweep rate
;*****************************************************************

                ldab    #8              ;make sweep / window adjustments
                abx
                ldd     0,x
                addd    baslimit
                std     tlimits
                ldd     0,x
                addd    baslimit+2
                std     tlimits+2

;*****************************************************************
;       Check external flags and sensors
;*****************************************************************


                ldaa    p4data  ;check external inhibit
                bita    #08h
                beq     no_inh
```

```
                ldaa    #0ffh   ;set external inhibit flag
                staa    inhflg

                ldaa    p2data  ;disable video input
                oraa    #08h
                staa    p2data
                bra     alarmen

no_inh      clr     inhflg  ;clear external inhibit flag
                ldaa    p2data  ;enable video input
                anda    #0f7h
                staa    p2data

alarmen     ldab    #0ffh   ;set alarm enable flag
                stab    almenflg

                ldaa    p4data
                bita    #00010000b      ;test people sensor enable
                bne     ptimstat                ; sensor enabled
                clr     pstimflg
                bra     valchk

ptimstat        tst     pstimflg                ;people sensor timer running?
                beq     psense
                ldaa    #pstmax         ;check for people sensor timeout
                cmpa    pstimer
                bhi     valchk
pt_inh      clr     almenflg
                clr     pstimflg
                bra     valchk
psense      bita    #00100000b      ;sensor active?
                bne     pt_inh
                clr     pstimer         ;start people sensor timer
                ldaa    #0ffh
                staa    pstimflg

;*****************************************************************
;       Check and time sort valid target responses
;*****************************************************************

valchk      tst     vflag           ;valid reply?
                beq     timechk
                clr     vflag
                ldd     tmark           ;save last valid time
                std     tbuff
                ldd     tend                    ;get new valid time
                std     tmark
                tst     srchflg         ;acquire mode 'clear'
                beq     pulsel
                ldd     tmark           ;reply in window?
                subd    time95
                bmi     early           ;reply too early
vmext1      subd    swpmin
                addd    swpmax
                bpl     failsrch                ;reply too late
                ldd     tmark           ;update next window
                addd    swpmax
                std     time95
```

```
;*****************************************************************
;          Adjust up / down alarm threshold counter
;*****************************************************************

                    inc     tagcnt
                    ldaa    tagcnt          ;alarm condition?
                    tsta                            ;valid tag threshold det.
                    bpl     thresh
                    clr     tagcnt          ;zero negative count
                    jmp     noalarm

thresh      cmpa    #10                     ;limit counter
                    blt     cntest
                    ldaa    #10
                    staa    tagcnt

cntest      ldaa    tagcnt          ;test for thresh. count
                    cmpa    tripcnt
                    blo     noalarm
                    ldaa    #0ffh           ;set alarm flag
                    staa    almflg
                    clr     vcnt
                    bra     vexit

timechk     ldd     tmark           ;check for timeout
                    addd    swpmin
                    subd    timer
                    bmi     failsrch
                    bra     vexit

failsrch            clra                            ;reset flags
                    staa    almflg
                    staa    vcnt
                    dec     tagcnt
                    bgt     fnext
                    staa    srchflg         ;lose aquisition
                    staa    tagcnt
fnext       ldd     tmark           ;update time slots
                    addd    swptime
                    std     tmark
                    addd    swpmax
                    std     time95
                    bra     vexit

pulsel      ldd     tmark           ;init. search effort
                    addd    swpmax
                    std     time95
                    clra                            ;adjust counters / timers
                    staa    vcnt
                    staa    almflg
                    coma
                    staa    srchflg
                    inc     tagcnt
                    bra     vexit

early       ldd     tbuff           ;restore original valid time
                    std     tmark
                    inc     vcnt                    ;c.b. inhibit function
                    ldaa    #5
```

```
                cmpa    vcnt
                bgt     vexit
                clra                    ;too many replies
                staa    almflg
                staa    srchflg
                staa    tagcnt
                staa    vcnt
                bra     vexit

noalarm         clr     vcnt
                clr     almflg

vexit           ldaa    p4data          ;tp4 low
                anda    #01111111b
                staa    p4data

alarm           tst     almflg          ;check alarm status
                bne     setime
                tst     atimflg         ;timer running?
                beq     alarmoff
                tst     atimer          ;timeout?
                bhi     a_enbl
                clr     atimflg
                bra     alarmoff

setime          ldaa    p1data          ;read alarm time select
                bita    #00100000b
                beq     five
                ldaa    #onesec
                staa    atimer
                bra     aflag
five            ldaa    #fivsec
                staa    atimer
aflag           ldaa    #0ffh           ;set alarm timer flag
                staa    atimflg

a_enbl          tst     almenflg        ;alarm enabled?
                beq     alarmoff
                ldaa    p4data          ;turn alarms on
                oraa    #02h
                staa    p4data
                ldaa    p1data          ;read alarm select
                bita    #10h
                bne     beeper

                ldaa    p4data          ;steady alarm
                oraa    #04h
                staa    p4data
                bra     next

alarmoff        ldaa    p4data          ;turn off alarms
                anda    #0f9h
                staa    p4data
                bra     next

beeper          ldab    #maskon         ;pulsed alarm
                andb    rtclk
                bne     hipulse
                ldaa    p4data          ;reset pulse output
```

```
                anda    $0fbh
                staa    p4data
                bra     next

hipulse         ldaa    p4data          ;set pulse output
                oraa    $04h
                staa    p4data

next            jmp     main

;*****************************************************************
;          Internal time clock routine (interrupt)
;*****************************************************************

timeclk         ldaa    tcsr            ;clear ocr flag
                ldd     ocr             ;reset interrupt flag
                std     ocr
                cli
                inc     rtclk
                inc     pstimer
                dec     atimer
                rti

;*****************************************************************
;          Composite video processing routine
;*****************************************************************

tdet            ldaa    pldata  ;determine + / - threshold
                anda    $00001100b
                cmpa    $0ch            ;false level detect
                beq     tfaulti
                bita    $00000100b      ;+ threshold?
                bne     tminusl
                clr     signflg
                bra     window
tminusl         ldaa    $0ffh
                staa    signflg

window          ldd     icr             ;get tll , twl
                std     tlead
                addd    $twoffset       ;compute end time window
                std     tdrop

                ldx     $tdetlim        ;delta time table

nslope          ldaa    tcsr            ;arm falling edge (+)
                oraa    $02h
                staa    tcsr
                ldaa    icr             ;clear icf flag

icflpl          ldaa    tcsr            ;wait for icflag
                bita    $80h
                bne     ftimesav
                ldd     tdrop
                subd    timer
                bmi     tfaulti
                bra     icflpl

tfaulti         jmp     texit
```

```
ftimesav        ldaa    tcsr            ;arm leading edge (-)
                anda    #0fdh
                staa    tcsr

                ldd     icr             ;get tf(n)
                std     tfall
                subd    tlead   ;delt(n) = tf(n) - tl(n)
                std     temp
                subd    0,x             ;delt > delt(min)
                bmi     texit
                ldab    #2              ;update limit addr. pointer
                abx
                ldd     temp            ;delt < delt(max)
                subd    0,x
                bpl     texit

;*****************************************************************
;       Next pulse adaptive computation
;*****************************************************************

                ldd     temp            ;update pulse limits
                addd    #180
                std     0,x
                ldx     #tdetlim
                ldd     temp
                addd    #2
                std     0,x

                dec     pcnt
                beq     valid

icflp2          ldaa    tcsr            ;wait for icflag(-)
                bita    #80h
                bne     signchk
                ldd     tdrop           ;check for window overflow
                subd    timer
                bmi     texit
                bra     icflp2

;*****************************************************************
;       Video sign alternation check
;*****************************************************************

signchk         ldaa    pldata  ;get threshold sign
                anda    #00001100b
                cmpa    #0ch            ;check for false levels
                beq     texit
                bita    #00000100b      ;+ threshold?
                bne     tminus2
                tst     signflg ;check for sign change
                beq     texit
                clr     signflg
                bra     tnext
tminus2 -       tst     signflg ; - ~~thresh~~  threshold
                bne     texit
                com     signflg

tnext           ldd     icr             ;get t(n)
                std     tlead
                bra     nslope
```

```
valid       ldaa    #0ffh   ;set valid reply flag
                    staa    vflag
                    ldd     tdrop   ;update valid time
                    std     tend
                    ldaa    p4data  ;valid reply ind. on t.o.5
                    anda    #10111111b
                    oraa    #01000000b
                    staa    p4data
                    ldab    #25             ;set valid pulse width (50us)
tpdly       decb
                    bne     tpdly
                    anda    #10111111b
                    staa    p4data
                    ldaa    tcsr            ;clear tag ringing edge
                    ldaa    icr

texit       ldaa    tcsr            ;rearm negative slope
                    anda    #0fdh
                    staa    tcsr
                    ldaa    icr             ;clear icf flag
                    ldaa    #2              ;restore counter / pointer
                    staa    pcnt
                    ldd     tlimits ;restore t1 pulse limits
                    std     tdetlim
                    ldd     tlimits+2
                    std     tdetlim+2
                    rti

;*****************************************************************
;           External signal adaptive inhibit function
;*****************************************************************

bni                 tst     bniflg          ;already in this routine?
                    bne     xrestore                ;restore index reg. on stack
                    ldaa    #0ffh           ;set bni active flag
                    staa    bniflg

                    ldaa    p2data          ;inhibit video for a time
                    oraa    #08h
                    staa    p2data

                    ldx     #320            ;delay time = (20 + 2.5 * N) us.
bnidly      cli
                    dex
                    bne     bnidly
                    sei

                    tst     inhflg  ;check external inhibit flag
                    bne     bnext

                    anda    #0f7h   ;enable video line
                    staa    p2data

bnext       ldaa    tcsr            ;clear possible icr flag
                    ldaa    icr             ;when video is enabled
                    clr     bniflg
                    rti
```

```
xrestore        tsx                     ;form pointer to stacked xreg
                ldd     #500            ;restore original delay value
                std     3,x
                rti

;*****************************************************************
;       Initial pulse window table
;*****************************************************************


t1limits        dw      320,500         ;window times (0.5us)
t2limits        dw      360,500
t3limits        dw      400,500
t4limits        dw      420,500

;*****************************************************************
;         Sweep rate select parameter table
;*****************************************************************


swptbl          dw      swp78
                dw      swp90
                dw      swp86
                dw      swp82
                dw      swpmin78
                dw      swpmin90
                dw      swpmin86
                dw      swpmin82
                dw      swpmax78
                dw      swpmax90
                dw      swpmax86
                dw      swpmax82
                dw      swpadj78
                dw      swpadj90
                dw      swpadj86
                dw      swpadj82


                org     0ff00h  ;version i.d. string
                db      'ALPHA RECEIVER VER. 1.2A   10/10/88'


                org     0ffeeh
                dw      reset   ;lost processor recovery trap


                org     0fff4h
                dw      timeclk ;coarse real time clk using
                                ;ocr overflow


                org     0fff6h
                dw      tdet            ;threshhold detector (timer) interrupt


                org     0fff8h  ;beat note detection interrupt
                dw      bni


                org     0fffeh
                dw      reset   ;start of reset section

                end     reset
```

What is claimed is:

1. An electronic article surveillance system comprising a transmitter for providing a signal to a transmitting antenna, to develop an electromagnetic field, and a receiving antenna for receiving signals including signals produced by a resonant circuit forming part of a tag means associated with an article to be protected, and for providing said received signals to a receiver having means for identifying said tag signals, wherein said tag signals are in the form of a series of pulses, wherein said receiver includes processor means for identifying said tag signals, and wherein said identifying means includes means for determining if a first pulse in said series of pulses has a duration which falls within a selected window, and means for determining if a second pulse in said series of pulses has a duration which falls within a window which varies in duration responsive to the duration of said first pulse.

2. An electronic article surveillance system comprising a transmitter for providing a signal to a transmitting antenna, to develop an electromagnetic field, and a receiving antenna for receiving signals including analog signals produced by a resonant circuit forming part of a first tag means associated with an article to be protected, and for providing said received signals to a receiver having means for identifying said tag signals produced by the resonant circuit of said first tag means and analog tag signals produced by the resonant circuit of a second tag means different from said first tag means, said receiver including means for converting said analog signals to digital signals, said converting means operating responsive to two different threshold levels, one of said two different threshold levels operating to define a leading edge of a digital pulse, and another of said two different threshold levels operating to define a trailing edge of said digital pulse.

3. An electronic article surveillance system comprising a transmitter for providing a signal to a transmitting antenna, to develop an electromagnetic field, and a receiving antenna for receiving signals including signals produced by a resonant circuit forming part of a first tag means associated with an article to be protected, and for providing said received signals to a receiver having means for identifying said tag signals, and means for discriminating between the tag signals produced by the resonant circuit of said first tag means and tag signals produced by the resonant circuit of a second tag means different from said first tag means, said tag signals being in the form of a series of pulses, said receiver including processor means for identifying said tag signals, said identifying means including means for determining if a first pulse in said series of pulses has a duration which falls within a selected window and means for determining if a second pulse in said series of pulses has a duration which falls within a window which varies responsive to the duration of said first pulse, and said selected window being adjustable according to the tag means which is to be detected.

4. An electronic article surveillance system comprising a transmitter for providing a signal to a transmitting antenna, to develop an electromagnetic field, and a receiving antenna for receiving signals including signals produced by a resonant circuit forming part of a first tag means associated with an article to be protected, and for providing said received signals to a receiver having means for identifying said tag signals, and means for discriminating between the tag signals produced by the resonant circuit of said first tag means and tag signals produced by the resonant circuit of a second tag means different from said first tag means, said tag signals being in the form of a series of pulses, said receiver including processor means for identifying said tag signals, said identifying means including means for determining if a first pulse in said series of pulses has a duration which falls within a selected window and means for determining if a second pulse in said series of pulses has a duration which falls within a window which varies responsive to the duration of said first pulse, and said receiver further including a counter for counting tag signals identifying by said processor means, said counter being incremented when said tag signals are identified within a prescribed time period, and decremented when said tag signals are not identified within said prescribed time period.

5. An electronic article surveillance system comprising a transmitter for providing a signal to a transmitting antenna, to develop an electromagnetic field, and a receiving antenna for receiving signals including signals produced by a resonant circuit forming part of a tag means associated with an article to be protected, and for providing said received signals to a receiver having means for identifying said tag signals, wherein said tag signals are analog signals, wherein said receiver includes means for converting said analog signals to digital signals, and wherein said converting means operates responsive to two different threshold levels, one of said two different threshold levels operating to define a leading edge of a digital pulse, and another of said two different threshold levels operating to define a trailing edge of said digital pulse.

6. An electronic article surveillance system comprising a transmitter for providing a signal to a transmitting antenna, to develop an electromagnetic field, and a receiving antenna for receiving signals including signals produced by a resonant circuit forming part of a tag means associated with an article to be protected, and for providing said received signals to a receiver having means for identifying said tag signals, wherein said tag signals are in the form of a series of pulses, wherein said receiver includes processor means for identifying said tag signals, and wherein said identifying means includes means for determining if a first pulse in said series of pulses has a duration which falls within a selected window, and means for determining if a second pulse in said series of pulses has a duration which falls within a window which varies in duration responsive to the duration of said first pulse, said selected window being adjustable according to the tag means which is to be detected.

7. An electronic article surveillance system comprising a transmitter for providing a signal to a transmitting antenna, to develop an electromagnetic field, and a receiving antenna for receiving signals including signals produced by a resonant circuit forming part of a tag means associated with an article to be protected, and for providing said received signals to a receiver having means for identifying said tag signals, wherein said tag signals are in the form of a series of pulses, wherein said receiver includes processor means for identifying said tag signals, and wherein said identifying means includes means for determining if a first pulse in said series of pulses has a duration which falls within a selected window, and means for determining if a second pulse in said series of pulses has a duration which falls within a window which varies in duration responsive to the duration of said first pulse, said receiver further including a counter for counting tag signals identified by said processor means, said counter being incremented when said tag signals are identified with a prescribed time period, and decremented when said tag signals are not identified within said prescribed time period.

8. An electronic article surveillance system comprising a transmitter for providing a signal to a transmitting antenna, to develop an electromagnetic field, and a receiving antenna for receiving signals including signals produced by a resonant circuit forming part of a first tag means associated with an article to be protected, and for providing said received signals to a receiver having means for identifying said tag signal, and means for discriminating between the tag signals produced by the resonant circuit of said first tag means and tag signals produced by the resonant circuit of a second tag means different from said first tag means, said tag signals being in the form of a series of pulses, said receiver including processor means for identifying said tag signals, and said identifying means including means for determining if a first pulse in said series of pulses has a duration which falls within a selected window and means for determining if a second pulse in said series of pulses has a duration which falls within a window which varies in duration responsive to the duration of said first pulse.

9. An electronic article surveillance system comprising a transmitter for providing a signal in an operating frequency range to a transmitting antenna, to develop an electromagnetic field, and a receiving antenna for receiving signals in said operating frequency range including signals produced by a first resonant circuit which is resonant in said operating frequency range and forming part of a first tag means associated with an article to be protected, and a second resonant circuit different from said first resonant circuit which is resonant in said operating frequency range and forming part of a second tag means associated with a different article to be protected, and for providing said received signals to a receiver having means for identifying said tag signals, and means for discriminating between first tag signals produced by the first resonant circuit of said first tag means and second tag signals produced by the second resonant circuit of said second tag means.

10. The system of claim 9 wherein said receiver includes a filter for separating said tag signals from other signals received by said receiver, and wherein said filter is a linear phase filter.

11. The system of claim 9 wherein said tag signals are analog signals having positive and negative polarities, wherein said receiver includes means for converting said analog signals to digital signals, and wherein said converting means operates responsive to two threshold levels for each of said positive and negative polarities, said threshold levels having different magnitudes.

12. The system of claim 11 wherein one of said two threshold levels operates to define a leading edge of a digital pulse, and another of said two threshold levels operates to define a trailing edge of said digital pulse.

13. The system of claim 9 wherein said tag signals are in the form of a series of pulses, wherein said receiver includes processor means for identifying said tag signals, and wherein said identifying means includes means for determining if a first pulse in said series of pulses has a duration which falls within a selected window, and means for determining if a second pulse in said series of pulses has a duration which falls within a window which varies in duration responsive to the duration of said first pulse.

14. The system of claim 13 wherein said selected window is adjustable according to the tag means which is to be detected.

15. The system of claim 13 wherein said receiver includes a counter for counting tag signals identified by said processor means, and wherein said counter is incremented when said tag signals are identified within a prescribed time period, and decremented when said tag signals are not identified within said prescribed time period.

16. The system of claim 9 wherein said transmitter produces a primary signal which is periodically swept about said primary signal at a defined rate, and wherein said rate is adjustable.

17. An electronic article surveillance system comprising a transmitter for providing a signal to a transmitting antenna, to develop an electromagnetic field, and a receiving antenna for receiving signals including signals produced by a resonant circuit forming part of a tag means associated with an article to be protected, and for providing said received signals to a receiver having means for identifying said tag signals, wherein said tag signals are analog signals having positive and negative polarities, wherein said receiver includes means for converting said analog signals to digital signals, wherein said converting means operates responsive to two different threshold levels for each of said positive and negative polarities, and wherein for each of said positive and negative polarities, the magnitude of one of said two different threshold levels differs from the magnitude of the other of said two different threshold levels.

18. The system of claim 17 wherein the two different threshold levels are of the same polarity.

19. The system of claim 17 wherein one of said two different threshold levels operates to define a leading edge of a digital pulse, and another of said two different threshold levels operates to define a trailing edge of said digital pulse.

* * * * *